US011384926B2

(12) United States Patent
Zhang et al.

(10) Patent No.: US 11,384,926 B2
(45) Date of Patent: Jul. 12, 2022

(54) CABINET LIGHTING POWER-TAKING SYSTEM

(71) Applicant: Shenzhen Step Electronic and Lighting Co., Ltd, Shenzhen (CN)

(72) Inventors: Huilong Zhang, Shenzhen (CN); Pengfei Tang, Shenzhen (CN); Min Hua, Shenzhen (CN)

(73) Assignee: Shenzhen Step Electronic and Lighting Co., Ltd, Shenzhen (CN)

( * ) Notice: Subject to any disclaimer, the term of this patent is extended or adjusted under 35 U.S.C. 154(b) by 0 days.

(21) Appl. No.: 17/216,889

(22) Filed: Mar. 30, 2021

(65) Prior Publication Data

US 2022/0074579 A1 Mar. 10, 2022

(30) Foreign Application Priority Data

Sep. 9, 2020 (CN) ..... 202010944531.1

(51) Int. Cl.

| | |
|---|---|
| ***F21V 23/00*** | (2015.01) |
| ***F21S 4/28*** | (2016.01) |
| ***A47B 96/00*** | (2006.01) |
| ***F21V 17/10*** | (2006.01) |
| ***F21V 23/02*** | (2006.01) |

(Continued)

(52) U.S. Cl.

CPC ..... *F21V 23/001* (2013.01); *A47B 96/00* (2013.01); *F21S 4/28* (2016.01); *F21V 17/105* (2013.01); *F21V 23/003* (2013.01); *F21V 23/007* (2013.01); *F21V 23/023* (2013.01); *A47B 2220/0077* (2013.01); *F21W 2131/301* (2013.01); *F21Y 2115/10* (2016.08)

(58) Field of Classification Search

CPC ..... A47B 2220/0077

See application file for complete search history.

(56) References Cited

U.S. PATENT DOCUMENTS 5,559,681 A * 9/1996 Duarte ..... F21V 21/08 362/231

5,580,155 A * 12/1996 Hildebrand ..... F25D 27/00 362/133

(Continued)

OTHER PUBLICATIONS

Extended European Search Report issued in counterpart European Patent Application No. 21166025.3, dated Sep. 14, 2021.

*Primary Examiner* — Alexander K Garlen

(74) *Attorney, Agent, or Firm* — Westbridge IP LLC

(57) ABSTRACT

The application discloses a cabinet lighting power-taking system including a cabinet, a power-taking assembly and lamps. The power-taking assembly includes at least one wire-distribution box, which is attached to and installed on a surface of the cabinet and is provided with a power-input interface and a plurality of power-output interfaces, so as to separate a single power-output interface into the plurality of power-output interfaces in parallel through shunt conversion. The power-input interface is configured for connecting a commercial power. The lamps are installed in the cabinet and plugged into the plurality of power-output interfaces one by one. This application improves an installation structure of the cabinet lighting power-taking system, and provides a structure that does not require slotting and wiring, which facilitates a process of installation, improves the efficiency of installation and optimizes the safety of using the lamps.

7 Claims, 4 Drawing Sheets

(51) Int. Cl.
*F21Y 115/10* (2016.01)
*F21W 131/301* (2006.01)

(56) References Cited

U.S. PATENT DOCUMENTS

| | | | | |
|---|---|---|---|---|
| 5,893,627 | A | 4/1999 | Tague | |
| 7,367,685 | B2 * | 5/2008 | Moll | A47B 97/00 312/223.5 |
| 10,401,018 | B1 * | 9/2019 | Smith | A47B 77/00 |
| 2004/0174701 | A1 | 9/2004 | Fiene | |
| 2011/0266929 | A1 * | 11/2011 | Michael | G06F 1/16 312/107 |
| 2019/0154241 | A1 | 5/2019 | Danville et al. | |
| 2020/0173643 | A1 * | 6/2020 | Smith | F21V 33/0016 |

* cited by examiner

CABINET LIGHTING POWER-TAKING SYSTEM

CROSS-REFERENCE TO RELATED APPLICATIONS

This application claims priority to Chinese Patent Application No. 202010944531.1 filed on Sep. 9, 2020, entitled "CABINET LIGHTING POWER-TAKING SYSTEM", the entire contents of which are hereby incorporated by reference.

TECHNICAL FIELD

The application relates to the technical field of lighting equipment, in particular to a cabinet lighting power-taking system.

BACKGROUND

LED cabinet lamps are a series of products developed based on lighting and decorative purposes. There are exquisite aluminum alloy lamps manufactured through molds. White light, warm light and cold light are ideal new light sources for household and commercial lighting, and have certain functions to replace the traditional ones. The color ones are ideal LED decorative lamps for indoor and outdoor corridors.

At present, for the LED cabinet lighting power-taking system on the market, slotting, drilling holes and distributing wires are required on a cabinet's shelf, and a plurality of wires are set on the back board. The overall wiring is troublesome with certain potential safety hazards.

Therefore, how to improve the assembly convenience of the lighting power supply system in the cabinet has become an urgent problem to be solved.

SUMMARY

The main purpose of the application is to provide a cabinet lighting power-taking system, aiming at improving the assembly convenience of the cabinet lighting power-taking system.

In order to achieve the above purpose, the application provides a cabinet lighting power-taking system including:

a cabinet body;

a power-taking assembly including at least one wire-distribution box, which is installed on the cabinet body and is provided with a power-input interface and a power-output interface to separate a single power-output interface into a plurality of power-output interfaces in parallel through shunt conversion, and the power-input interface is used for connecting a commercial power; and a plurality of lamps are installed in the cabinet body, and the plurality of lamps are plugged one to one with the plurality of power-output interfaces.

In one embodiment, the power-taking assembly further includes a power supply driver, and the power-input interface of the wire-distribution box is connected with a commercial power through the power supply driver; the power supply driver is configured for converting the power supply voltage into an operating voltage.

In one embodiment, the lamp includes a lamp body, a first lamp holder and a second lamp holder inserted with the first lamp holder, the first lamp holder is electrically connected with the second lamp holder, the first lamp holder is configured on the lamp body, and the second lamp holder is installed in the cabinet body and electrically connected with the power-output interface of the wire-distribution box.

In one embodiment, the first lamp holder and the second lamp holder are adsorbed and fixed by a magnet.

In one embodiment, the cabinet body includes a back board, a plurality of side boards and a plurality of shelves arranged around the back board, the back board and the plurality of side boards are enclosed to form a cuboid structure with a cabinet opening, and the plurality of shelves are arranged at intervals between two transversely opposite side boards along the height direction of the cabinet body and are attached to the back board.

In one embodiment, the lamp is installed on the shelf or the side boards.

In one embodiment, the back board is provided with a wire hole through which the terminal connecting line connecting the second lamp holder and the power-output interface of the wire-distribution box passes at the position corresponding to the lamp.

In one embodiment, the lamp further includes an installing member, the installing member is configured in the cabinet body, and the second lamp holder is configured in the cabinet body through the installing member.

In one embodiment, the shelf is provided with an embedded groove, and the installing member is arranged in the embedded groove.

In one embodiment, the cabinet lighting power-taking system further includes a controller, which is connected between the wire-distribution box and the lamp; the controller is configured for controlling the luminous color temperature or brightness of the lamp and controlling the on or off of the lamp.

In the technical scheme of the application, as the cabinet lighting power-taking system includes the cabinet body, the power-taking assembly and the lamp, the power-taking assembly includes at least one wire-distribution box. A line wire-distribution box is mount on that surface of the cabinet body and is provided with a power-input interface and a power-output interface, so as to separate a single power-output interface into a plurality of power-output interfaces in parallel through shunt conversion, the power-input interface is configured for connecting a commercial power, a plurality of lamps are installed in the cabinet body, and the plurality of lamps are plugged into the plurality of power-output interfaces one by one, therefor improving the assembly convenience of the lighting power-taking system in the cabinet.

BRIEF DESCRIPTION OF THE DRAWINGS

In order to have the present application or the technical scheme in the present technology more clearly explained, a brief description of the accompany drawings will be made in the description of embodiments or related art. It will be apparent that the drawings in the following description are only some embodiments of the application, and other drawings may be obtained from the structure shown in these drawings without creative effort by those of ordinary skill in the art.

Figure 1:
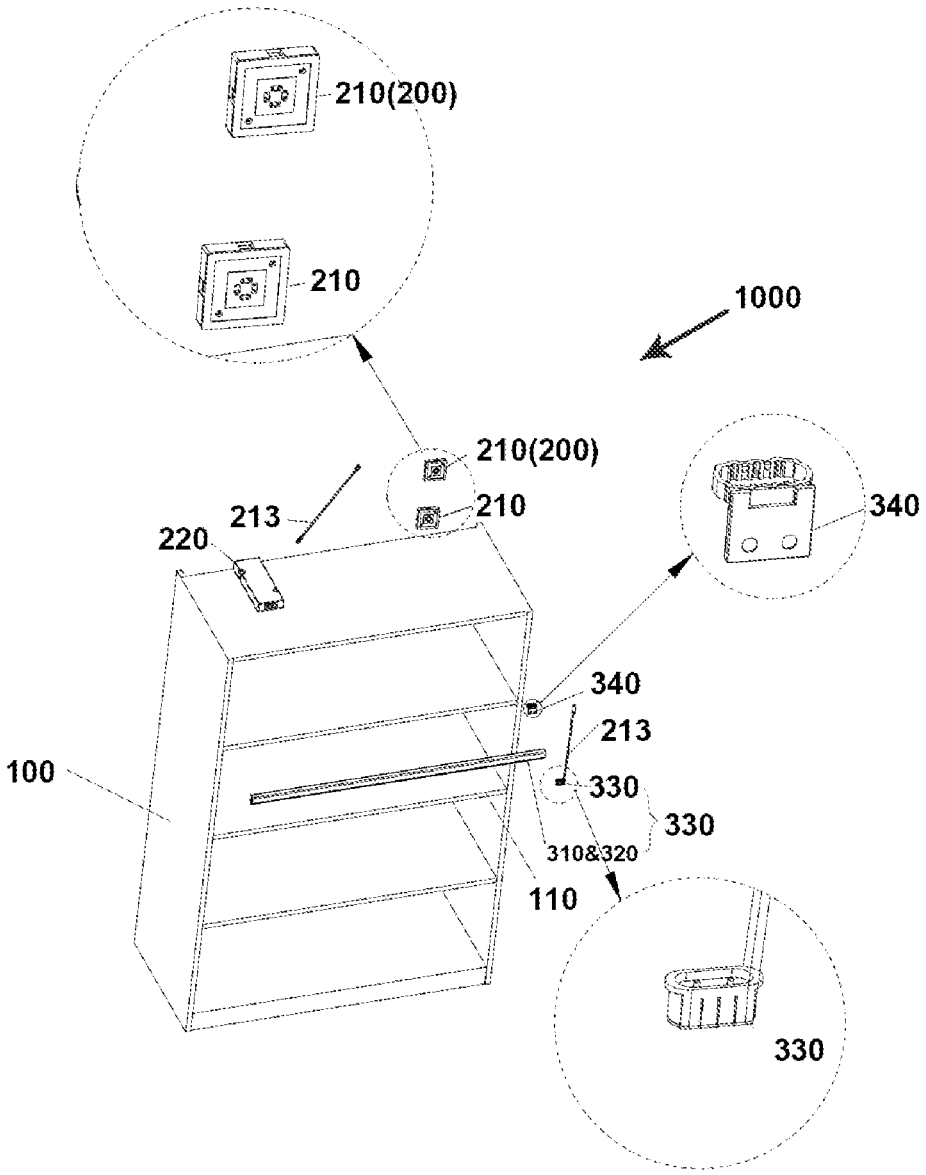
FIG. 1 is a schematic structural diagram of a front shelf lamp in an embodiment of a cabinet lighting power-taking system of the present application.

The realization, functional features and advantages of the present application will be further explained in connection with embodiments and with reference to the accompanying drawings.

DETAILED DESCRIPTION OF THE EMBODIMENTS

A clear and complete description of the technical aspect of the embodiments of the present application will be given below in connection with the accompanying drawings of the present application, and it will be apparent that the described embodiments are only part of the embodiments of the present application, and not all of them. Based on the embodiments in the application, all other embodiments obtained by those of ordinary skill in the art without creative work fall within the claimed scope of the application.

It should be noted that all directional indications (such as top, bottom, left, right, front, rear, etc.) in embodiments of the present application are only used to explain the relative positional relationship, motion situation, etc. between parts under a specific posture (as shown in the drawings). If the specific posture changes, the directional indications also change accordingly.

In addition, descriptions of "first", "second" and the like in the present application are used for descriptive purposes only and cannot be understood as indicating or implying their relative importance or implying the number of indicated technical features. Therefore, features defined as "first", "second" may explicitly or implicitly include at least one of the features. In addition, the meaning of "and/or" appearing in the full text is to include three parallel schemes. Take "A and/or B" as an example, it includes Scheme A, Scheme B, or Scheme A and B satisfying at the same time. In addition, the technical solutions between various embodiments can be combined with each other, but must be based on the ability of one of ordinary skill in the art to realize, and when the combination of technical solutions is inconsistent or cannot be realized, it should be considered that the combination of such technical solutions does not exist and is not within the claimed scope of the present application.

LED cabinet lamps are a series of products developed based on lighting and decorative purposes. There are exquisite aluminum alloy lamps manufactured through molds. White light, warm light and cold light are ideal new light sources for household and commercial lighting, and have certain functions to replace the traditional ones. Colorful lights are ideal LED decorative lamp for indoor and outdoor corridors.

In an exemplary embodiment, lamps of a LED cabinet lamp are installed in a cabinet. During installation, it is necessary to slot a shelf of the cabinet, drill holes and distribute wires, and arrange a plurality of wires on a back board, thus the overall wiring is relatively troublesome.

In order to improve the assembly convenience of cabinet lighting power-taking systems, the application provides a cabinet lighting power-taking system, which is suitable for but is not limited to storage cabinets such as LED cabinets or article display cabinets.

According to FIGS. 1 to 4, in one embodiment of the present application, the cabinet lighting power-taking system includes a cabinet 100, a power-taking assembly 200, and lamps 300. The power-taking assembly 200 includes at least one wire-distribution box 210, which is installed on a surface of the cabinet 100 and is provided with a power-input interface and a plurality of power-output interface for splitting a single power-output interface into the plurality of power-output interfaces in parallel through shunt conversion. The power-input interface is configured for receiving a commercial power. A plurality of lamps 300 are installed in the cabinet 100, and the plurality of lamps 300 are plugged one to one with the plurality of power-output interfaces.

Specifically, the cabinet body 100 may be made of wood board, plastic board, glass board, aluminum alloy board or stainless steel board, etc., which is not limited here.

Figure 4:
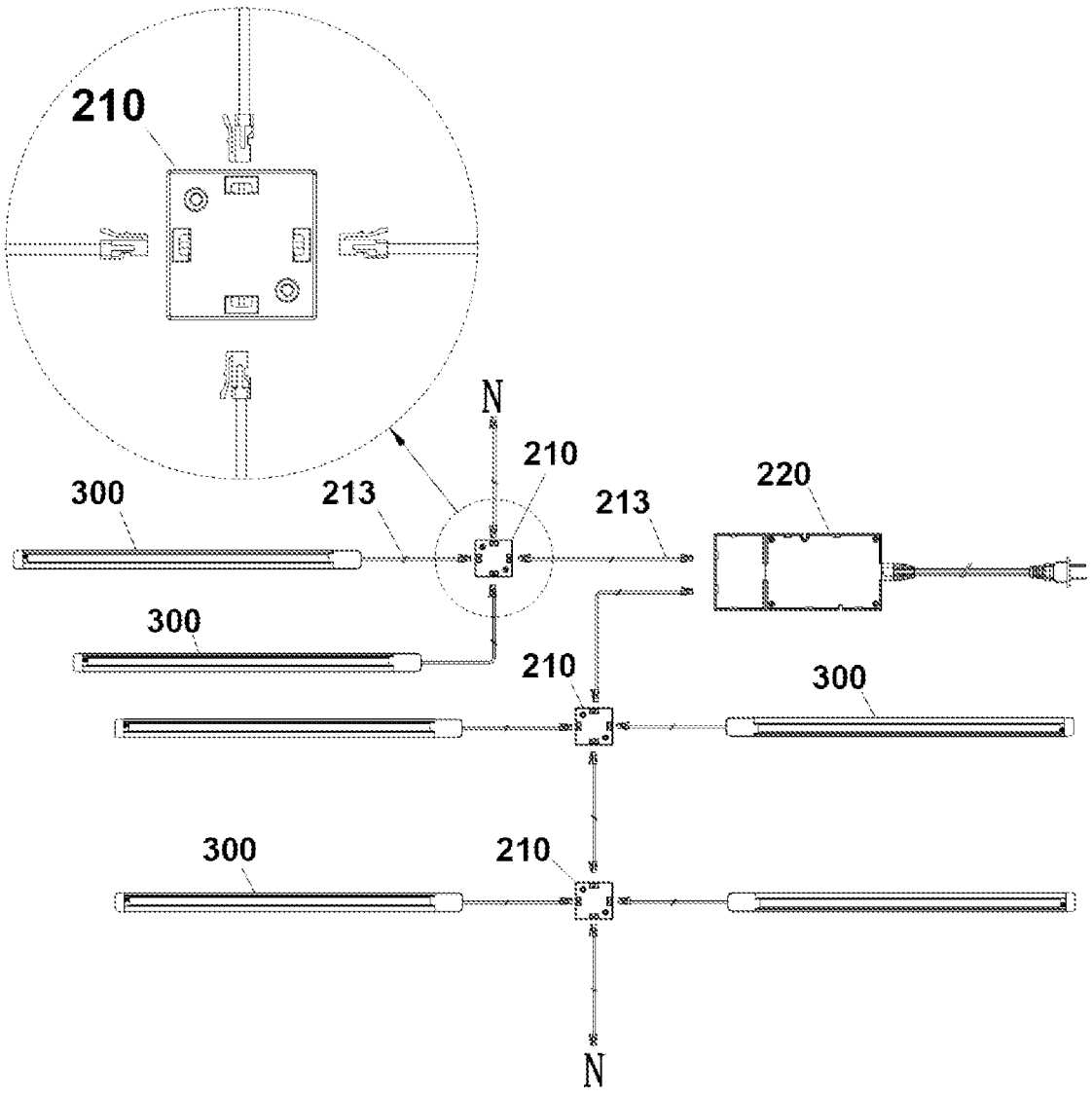
FIG. 4 is a system wiring diagram of an embodiment of the cabinet lighting power-taking system of the present application.

Primarily according to FIG. 4, a main body of the wire-distribution box 210 of the power-taking assembly 200 may have a square structure or other shapes, and may be made of non-conductive materials. The plurality of power-output interface for receiving connection terminals of terminal connecting wires 213 of the lamps 300 may be arranged on a periphery of the main body, in order to connect the lamp 300 to the commercial power.

In this embodiment, the lamps 300 are installed inside the cabinet 100 and can be connected to the power-output interfaces on the wire-distribution box 210 on the back board of the cabinet 100 through the terminal connecting wires 213 from the lamps 300. A lamp body 310 of each lamp 300 may be constituted by a COB lamp band with LED beads (COB, Chip On Board) or a FPC lamp band (FPC, Flexible Printed Circuit) and the like, and a shell, the lamp body 310 may be in the form of a strip, a circle or other shapes, and is not limited here.

During assembly in production or on site, the wire-distribution box 210 can be installed on the back of the cabinet 100 by means of screw connection or glue bonding, etc., and then the lamps 300 can be installed on a shelf 110 or a side board in the cabinet 100, and the terminal connecting wires 213 from the lamps 300 can be connected to the power-output interfaces on the wire-distribution box 210. In this way, the assembly of the whole cabinet lighting power-taking system is completed, the whole assembly process is simple and convenient. When a lamp 300 is damaged, users may replace a new lamp 300 by themselves. The operation is simple, and the user experience is improved.

Understandably, in the technical scheme of the application, as the lighting power-taking system in the cabinet includes the cabinet 100, the power-taking assembly 200 and the lamps 300, the power-taking assembly 200 includes at least one wire-distribution box 210, which is attached to the surface of the cabinet 100 and is provided with a power-input interface and a plurality of power-output interfaces, so as to distribute a single power-output interface into a plurality of power-output interfaces in parallel through shunt conversion. The power-input interface is configured for connecting a commercial power, the plurality of lamps 300 are installed in the cabinet 100, and the plurality of lamps 300 are plugged into the plurality of power-output interfaces one to one, thus improving the assembly convenience of the lighting power-taking system in the cabinet.

In order to realize the electrical connection between the lamps 300 and the power-taking assembly 200, in one embodiment, the power-taking assembly 200 may further include a power supply driver 220 for providing an operating voltage, and the power-input interface of the wire-distribution box 210 is connected to the commercial power through the power supply driver 220.

It should be noted that the power supply driver 220 in this embodiment is arranged to convert the mains voltage into the operating voltage of the lamps 300.

Figure 2:
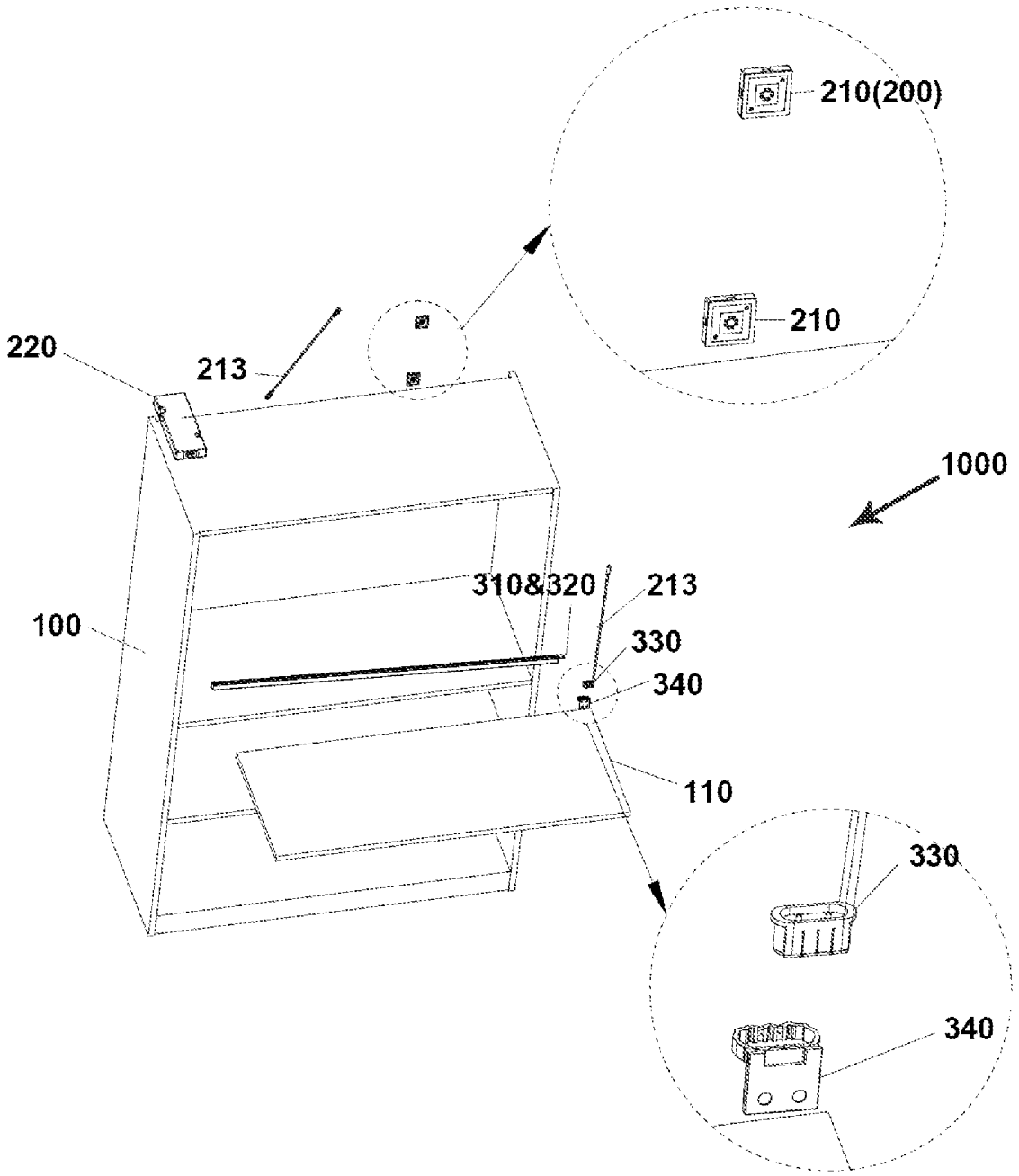
FIG. 2 is a structural schematic diagram of a rear shelf lamp in an embodiment of the cabinet lighting power-taking system of the present application.
Figure 3:
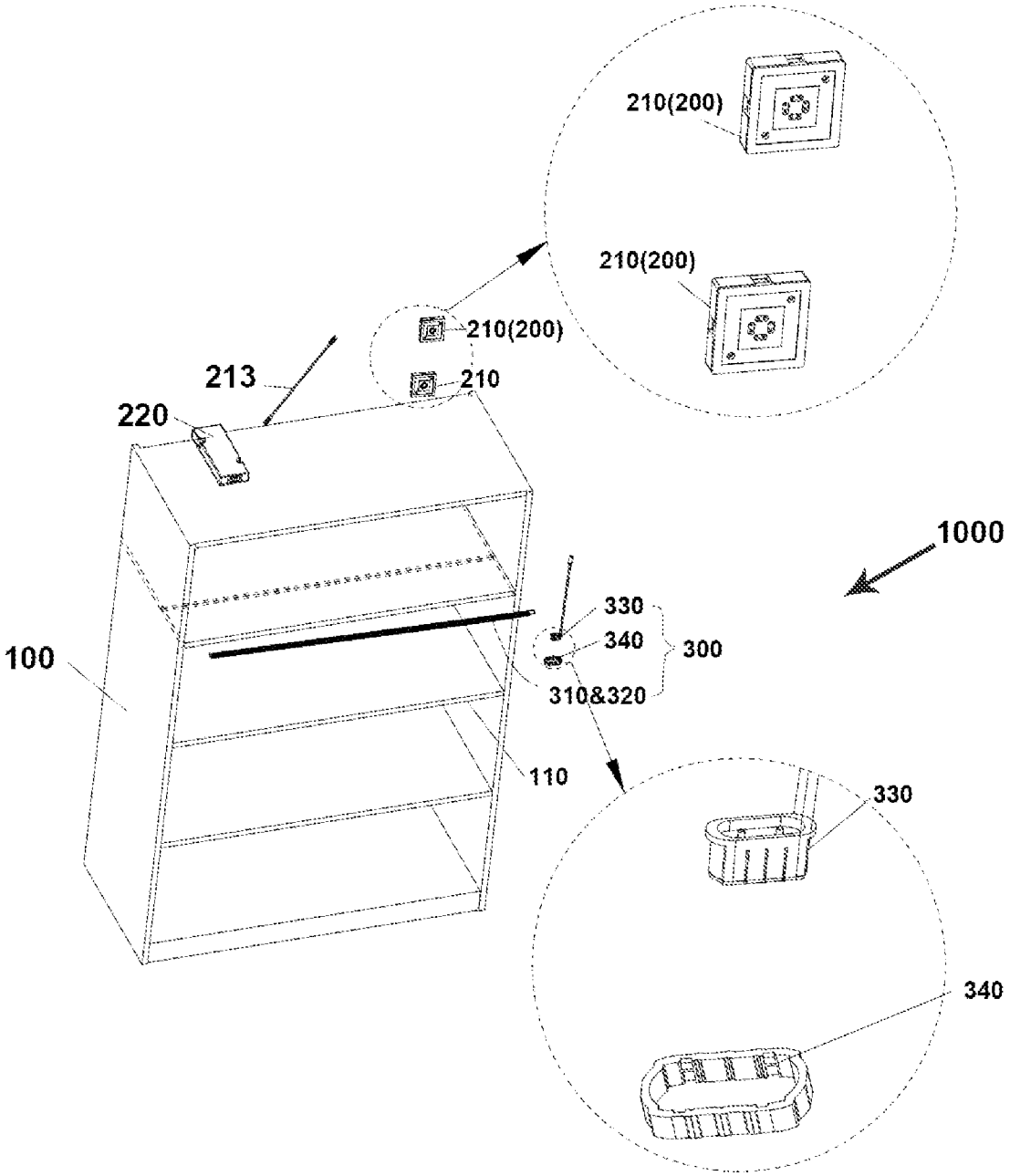
FIG. 3 is a structural schematic diagram of an embedded profile light in an embodiment of the cabinet lighting power-taking system of the present application.

According to FIGS. 1 to 3, in some embodiments, each lamp 300 may include a lamp body 310, a first lamp holder 320 and a second lamp holder 330 that is inserted in the first lamp holder 320 and electrically connected to the first lamp holder 320. The first lamp holder 320 is disposed on the lamp body 310, and the second lamp holder 330 is installed in the cabinet 100 and electrically connected to a power-output interface of the wire-distribution box 210 through a terminal connecting wire 213.

In this embodiment, according to FIG. 4, the second lamp holder 330 and the wire-distribution box of the power-taking assembly 200 are connected through the terminal connecting wire 213. The terminal connecting wire 213 is generally extended from the second lamp holder 330. An outgoing terminal of the terminal connecting wire 213 is electrically connected with a power-output interface of the wire-distribution box 210 by plugging in to facilitate wiring. Specifically, the first lamp holder 320 and the second lamp holder 330 can be adsorbed and fixed by magnets. Of course, in some embodiments, an engagement structure or the like may be provided at joints of the terminal connecting wire 213 of the second lamp holder 330 and the power-output interface of the wire-distribution box 210 for inserting and pulling out the terminal connecting wire 213.

According to FIGS. 1 to 3, in order to improve the installation convenience of the lamp 300, in one embodiment, the cabinet 100 includes a back board, a plurality of side boards arranged around the back board and a plurality of shelves 110. The back board and the plurality of side boards are enclosed to form a cuboid-shaped structure with a cabinet opening. The plurality of shelves 110 are spaced along a height direction of the cabinet 100 between two lateral opposite side boards and are attached to the back board. Specifically, the lamps 300 are installed on the shelves 110 to obtain a better light irradiation range.

According to FIGS. 1 to 3, the lamps 300 of the present embodiment may be installed on the front side (front shelf lamp), or the rear side (rear shelf lamp) of the shelves 110 or embedded in the shelf 110 (embedded profile light). The specific installing position and method thereof are not limited here.

In the present embodiment, a wire hole is formed at a position corresponding to each lamp 300 on the back board through which the terminal connecting wire 213 connecting the second lamp holder 330 and the power-output interface of the wire-distribution box 210 passes. With this arrangement, it is convenient to connect the lamp 300 with the power-taking system, reducing the wiring structure, and improving the assembly convenience of the light lighting power-taking system in the cabinet.

According to FIGS. 1 to 3, in order to fix each lamp 300 on the cabinet 100 and facilitate wiring, in one embodiment, the lamp 300 may further include an installing member 340, which is disposed in the cabinet 100, and the second lamp holder 330 is installed in the cabinet 100 through the installing member 340.

In order to prevent the installing member 340 from protruding on the shelf 110 in the cabinet 100 and affecting the user to place articles into the cabinet 100, in one embodiment, the shelf 110 may be provided with an embedded groove, and the installing member 340 is arranged in the embedded groove. In this arrangement, the installing member 340 can be flush with a surface of the cabinet body 100 as far as possible, and the lighting power-taking system in the cabinet may also enhance a certain industrial aesthetic feeling.

In one embodiment, in order to further control the lamp 300 to achieve a certain lighting effect, the cabinet lighting power-taking system may further include a controller (not shown) through which the wire-distribution box 210 is connected to the lamps 300. The controller is configured to control the luminous color temperature or brightness of the lamps 300 and to control the opening or closing of the lamps 300.

In some application scenarios, the brightness, color temperature and continuous flashing time of the lamps 300 need to be adjusted to meet various lighting requirements of users. The controller in this embodiment can adjust the luminous color of the lamps 300 according to a preset program of a system, for example, in a first preset time range, the lamps 300 are controlled to emit red light, in a second preset time range, the lamps 300 are controlled to emit yellow light, in a third preset time range, the lamps 300 are controlled to emit white light, and in a fourth preset time, the lamps 300 are controlled to be powered off to stop emitting light, and the like. The specific control method of the controller is not limited here.

The foregoing is only an alternative embodiment of this application and is not thus limiting the scope of this application. Any equivalent structural transformation made under the inventive concept of the application using the contents of this specification and the accompanying drawings, or direct/indirect application in other related technical fields, is included in the scope of the application.

What is claimed is:

1. A cabinet lighting power-taking system, comprising:

a cabinet;

a power-taking assembly comprising at least one wire-distribution box, wherein the at least one wire-distribution box is installed on the cabinet and provided with a power-input interface and a plurality of power-output interfaces to separate a single power-output interface into the plurality of power-output interfaces in parallel through shunt conversion, and the power-input interface is configured for connecting a commercial power; and a plurality of lamps installed in the cabinet, wherein the plurality of lamps are plugged one to one with the plurality of power-output interfaces; wherein, the power-taking assembly further comprises a power supply driver, the power-input interface of the wire-distribution box is connected with the commercial power through the power supply driver; the power supply driver is configured for converting a power supply voltage into an operating voltage;

each lamp comprises a lamp body, a first lamp holder and a second lamp holder inserted in the first lamp holder and electrically connected with the first lamp holder, the first lamp holder is configured on the lamp body, and the second lamp holder is installed in the cabinet and electrically connected with a power-output interface of the wire-distribution box.

2. The cabinet lighting power-taking system according to claim 1, wherein the first lamp holder and the second lamp holder are adsorbed and fixed by a magnet.

3. The cabinet lighting power-taking system according to claim 1, wherein the cabinet body comprises a back board, a plurality of side boards arranged around the back board and a plurality of shelves, wherein the back board and the plurality of side boards are enclosed to form a cuboid structure with a cabinet opening, and the plurality of shelves are arranged at intervals between two transversely opposite side boards along a height direction of the cabinet and are attached to the back board.

4. The cabinet lighting power-taking system according to claim 3, wherein each lamp is installed on the shelf or a side board.

5. The cabinet lighting power-taking system according to claim 4, wherein the back board is provided with a wire hole through which a terminal connecting wire connecting the second lamp holder and the power-output interface of the wire-distribution box passes at a position corresponding to the lamp.

6. The cabinet lighting power-taking system according to claim 5, wherein the lamp further comprises an installing member, the installing member is configured in the cabinet, and the second lamp holder is configured in the cabinet through the installing member.

7. The cabinet lighting power-taking system according to claim 6, wherein the shelf is provided with an embedded groove, and the installing member is arranged in the embedded groove.

* * * * *